US012453921B2

(12) United States Patent
Chiang

(10) Patent No.: US 12,453,921 B2
(45) Date of Patent: Oct. 28, 2025

(54) CARD SLEEVES

(71) Applicant: Heavy Play LLC, Burlingame, CA (US)

(72) Inventor: Randy Yang Chiang, Burlingame, CA (US)

(73) Assignee: HEAVY PLAY LLC, Burlingame, CA (US)

( * ) Notice: Subject to any disclaimer, the term of this patent is extended or adjusted under 35 U.S.C. 154(b) by 748 days.

(21) Appl. No.: 17/744,583

(22) Filed: May 13, 2022

(65) Prior Publication Data

US 2023/0321520 A1 Oct. 12, 2023

Related U.S. Application Data

(60) Provisional application No. 63/329,865, filed on Apr. 11, 2022.

(51) Int. Cl.
*A63F 1/10* (2006.01)

(52) U.S. Cl.
CPC ..... *A63F 1/10* (2013.01)

(58) Field of Classification Search
CPC ..... G09F 1/10; A45C 11/18; A45C 11/182; A63F 1/10; B65D 65/02; B65D 65/10; B65D 65/04
See application file for complete search history.

(56) References Cited

U.S. PATENT DOCUMENTS 5,090,561 A * 2/1992 Spector ..... G11B 23/40
5,159,964 A * 11/1992 Baker ..... B42F 5/04 150/147
5,245,775 A 9/1993 Goserud
5,259,136 A 11/1993 Goserud
10,293,245 B2 5/2019 Murase et al.
11,967,255 B2 * 4/2024 Friedman ..... G09F 1/10
(Continued)

FOREIGN PATENT DOCUMENTS

CN 118946389 A 11/2024
JP 2004351842 A 12/2004
(Continued)

OTHER PUBLICATIONS

Ultimate Guard—"Katana Sleeves"—Downloaded: Aug. 15, 2022—Available from Internet <URL:https://ultimateguard.com/en/Card-Sleeves/Katana-Sleeves/UGD010111/>.
(Continued)

*Primary Examiner* — Javier A Pagan
(74) *Attorney, Agent, or Firm* — Gallium Law; Jacob Panangat; Justin Schwechter

(57) ABSTRACT

In some examples, a card sleeve system includes an outer sleeve. According to some examples, the outer card sleeve includes an outer front sheet. The outer card sleeve may include an outer back sheet coupled to the outer front sheet along an outer bottom edge, an outer left edge, and an outer right edge of the outer sleeve. In some examples, an outer top edge of the outer card sleeve defines an outer opening configured to receive an inner card sleeve. According to some examples, an outer top left corner and an outer top right corner of the outer card sleeve define right angles. An outer bottom left corner and an outer bottom right corner of the outer card sleeve may define rounded corners.

20 Claims, 13 Drawing Sheets

(56) References Cited

U.S. PATENT DOCUMENTS

| | | | | |
|---|---|---|---|---|
| 2015/0174472 | A1 | 6/2015 | Keeling | |
| 2016/0331091 | A1* | 11/2016 | Hall | A45C 1/06 |
| 2017/0096270 | A1* | 4/2017 | Jauregui | A63F 1/10 |
| 2017/0274273 | A1 | 9/2017 | Murase et al. | |
| 2020/0122019 | A1* | 4/2020 | Brown | A63F 1/02 |
| 2021/0300628 | A1* | 9/2021 | Rosendahl | B65D 27/14 |
| 2021/0308557 | A1* | 10/2021 | Baldocchi | B42F 7/025 |
| 2021/0354027 | A1 | 11/2021 | Rosendahl | |
| 2023/0048773 | A1* | 2/2023 | Burko | G09F 1/10 |

FOREIGN PATENT DOCUMENTS

| | | | |
|---|---|---|---|
| JP | 3178647 | U | 9/2012 |
| JP | 2015202635 | A | 11/2015 |

OTHER PUBLICATIONS

Ultimate Guard—"Precise-Fit Sleeves"—Downloaded: Aug. 15, 2022—Available from Internet <URL:https://ultimateguard.com/en/Card-Sleeves/Precise-Fit-Sleeves/UGD010050/>.

Ultra-PRO—"Eclipse Matte Standard Deck Protector Sleeves (100ct)"—Downloaded: Aug. 15, 2022—Available from Internet <URL:https://ultrapro.com/products/eclipse-matte-standard-deck-protector-sleeves-100ct>.

Ultra-PRO—"PRO-Fit Standard Deck Inner Sleeves (100ct)"—Downloaded: Aug. 15, 2022—Available from Internet <URL:https://ultrapro.com/products/pro-fit-standard-deck-inner-sleeves-100ct>.

Dragon Shield—"Jet—Matte Sleeves—Standard Size"—Downloaded: Aug. 15, 2022—Available from Internet <URL:https://www.dragonshield.com/webshop/us/solid-color-sleeves/84-dragon-shield-matte-jet.html>.

Dragon Shield—"Clear—Toploading Perfect Fit Sleeves—Standard Size"—Downloaded: Aug. 15, 2022—Available from Internet <URL:https://www.dragonshield.com/webshop/us/solid-color-sleeves/140-dragon-shield-perfect-fit-clear_html>.

Cocolo Games—"KADOMARU: The R-Line Card Sleeves"—First available: Mar. 22, 2016—Downloaded Jun. 13, 2022—Available from Internet <URL:https://www.kickstarter.com/projects/cocolo/kadomaru-the-r-line-card-sleeves/posts>.

BELLROY—"Card Sleeve"—Downloaded: Jun. 13, 2022—Available from Internet <URL:https://bellroy.com/products/card-sleeve-wallet?color=charcoal&material=leather&size=default#slide-0>.

RDEXP—"RFID Blocking Sleeve Holder Credit Card Secure Protector Pack of 10 (Type 1)"—First available: Feb. 23, 2016—Downloaded: Jun. 13, 2022—Available from Internet <URL:https://www.amazon.com/Silver-Blocking-Sleeve-Holder-Protector/dp/B01C402IEY>.

CX&CHENXIN—"Round corner card sleeve"—Downloaded: Jun. 13, 2022—Available from Internet <URL:http://www.chenxinpkg.com/chanpinzhanshi/Comic_Book_Supplies/Round_corner_/2017/1109/32.html>.

CARDSHARKZ—"CARDSHARKZ™ Semi-Rigid"—Downloaded: Jun. 13, 2022—Available from Internet <URL: https://cardsharkz.com/product/cardsharkz-semi-rigid/>.

Ultra Pro—""Ultra Pro Soft Card Sleeves 2-⅝"×3-⅝", Ultra Clear (100Count)""—First available: Jan. 1, 2014—Downloaded: Jun. 13, 2022—Available from Internet <URL: https://www.amazon.com/Ultra-Pro-Sleeves-8-Inches-100-Count/dp/B0002TT3N4>.

Tolarian Community College—"MTG—Which Are The Best Card Sleeves? Monster vs Legion vs Player's Choice & More! Magic Gathering"—First available: Apr. 5, 2014—Downloaded: Jun. 13, 2022—Available from Internet <URL:https://www.youtube.com/watch?v=w-aAelZSNWw>.

WILLCH4000—"Where can I buy rounded sleeves?"—Reddit—First available: May 29, 2016—Downloaded: xxDATExx—Available from Internet <URL:https://www.reddit.com/r/magicTCG/comments/4ljxw1/where_can_i_buy_rounded_sleeves/>.

CHRISROSS102—"Eco-friendly card sleeves, they exist?"—Reddit—First available: Mar. 21, 2019—Downloaded: Jun. 13, 2022—Available from Internet <URL: https://www.reddit.com/r/magicTCG/comments/b3qj1q/ecofriendly_card_sleeves_they_exist/>.

Dremmy—"Play Box 62mm x 89mm Sleeve 2"—Yugibako Blog—Available from Internet <URL: http://yugibako.blog.fc2.com/blog-entry-434.html>—Downloaded Sep. 9, 2025.

Kerobo-Lain—"[Compare all types of card sleeves] Hyper Matte, Katana, Dragon Shield, Ultra Pro, etc. Pokemon Card"—NO+E—Sep. 30, 2021—Available from Internet <URL: https://note.com/pokemon_card/n/n9dcd91191d55>.

Apple Gym—"What are sleeves?"—Dec. 10, 2018 - Available from Internet <URL: https://applegym.amebaownd.com/posts/5380880/>.

* cited by examiner

CARD SLEEVES

BACKGROUND

Field

The present disclosure relates to containment systems, particularly for cards such as playing cards.

Description of Related Art

In the world of collectibles, such as trading cards or playing cards, users enjoy protecting their property against wear and tear, as well as dust, detriment, or other particulate. A common method of protecting cards is to use a sleeve, which is generally a thin plastic membrane into which a card is inserted. However, the use of a single sleeve will often still offer the opening into which the card is inserted for particulate to enter. Additionally, this unprotected edge of the card may still be subject to general wear and tear, as it does not enjoy the same protections as the rest of the card.

One solution to the existence of an unprotected edge is to have a sealable or fold-over type sleeve. However, this may add unwanted bulk to the sleeve, making actions such as shuffling more burdensome and clumsy. Another solution to this unprotected edge is to use multiple sleeves—an inner sleeve and an outer sleeve. This combination of sleeves allows protection of all four edges of a card, while still maintain the generally narrow profile of a single sleeve system. However, the solutions offered by sleeve systems including inner sleeves and outer sleeves have problems of their own, which will be explored more thoroughly in this disclosure.

SUMMARY

The present disclosure describes systems and techniques for containing a card, such as a playing card. The system may include separate subcomponents that are used in conjunction or separately based on the needs of the user.

In some examples, a card sleeve system includes an outer sleeve. According to some examples, the outer card sleeve includes an outer front sheet. The outer card sleeve may include an outer back sheet coupled to the outer front sheet along an outer bottom edge, an outer left edge, and an outer right edge of the outer sleeve. In some examples, an outer top edge of the outer card sleeve defines an outer opening configured to receive an inner card sleeve. According to some examples, an outer top left corner and an outer top right corner of the outer card sleeve define right angles. An outer bottom left corner and an outer bottom right corner of the outer card sleeve may define rounded corners.

In some examples, the outer front sheet comprises a finish selected from the group consisting of optically clear and translucent. According to some examples, the outer front sheet further comprises a texture selected from the group consisting of gloss, matte, and anti-glare. The outer front sheet may comprise a color.

In some examples, the outer back sheet comprises a finish selected from the group consisting of optically clear, translucent, at least partially opaque, and fully opaque. According to some examples, the outer back sheet comprises a color.

The outer front sheet may have a thickness between 0.115 mm and 0.125 mm. In some examples, the outer back sheet has a thickness between 0.135 mm and 0.145 mm. According to some examples, the outer card sleeve defines a height of between 91.3 mm and 92.3 mm. The outer card sleeve may define a width of between 66.3 mm and 67.3 mm. In some examples, the outer card sleeve defines a height of between 88.3 mm and 89.3 mm. According to some examples, the outer card sleeve defines a width of between 61.6 mm and 62.6 mm.

The card sleeve system may further comprise an inner card sleeve configured to insert into the outer card sleeve. In some examples, the inner card sleeve comprises an inner front sheet. According to some examples, the inner card sleeve further comprises an inner back sheet coupled to the inner front sheet along an inner top edge, an inner left edge, and an inner right edge of the inner card sleeve. An inner bottom edge of the inner card sleeve may define an inner opening configured to receive a card. In some examples, an inner top left corner and an inner top right corner of the inner card sleeve define right angles. According to some examples, an inner bottom left corner and an inner bottom right corner of the inner card sleeve define rounded corners. The inner front sheet may not be bonded to the inner back sheet along the rounded corners of the inner bottom left corner and the inner bottom right corner.

In some examples, the inner front sheet is optically clear. According to some examples, the inner back sheet comprises a finish selected from the group consisting of optically clear, at least partially opaque, and fully opaque.

The inner front sheet and the inner back sheet may have a thickness between 0.045 mm and 0.055 mm. In some examples, the inner card sleeve defines a height of between 88.9 mm and 89.9 mm. According to some examples, the inner card sleeve defines a width of between 63.7 mm and 64.7 mm. The inner card sleeve may define a height of between 86.5 mm and 87.5 mm. According to some examples, the inner card sleeve defines a width of between 59.8 mm and 60.8 mm.

The embodiments described above include many optional features and aspects. Features and aspects of the embodiments can be combined.

COMPONENT INDEX

Figure 1:
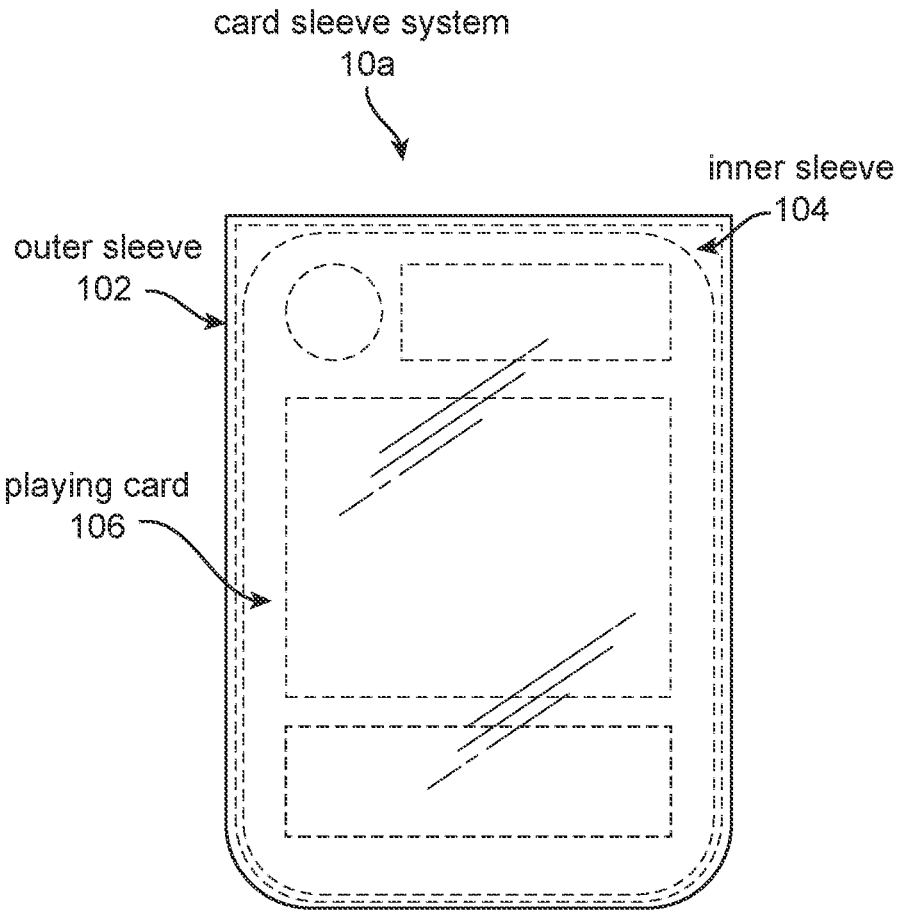
FIG. 1 is a front view of an example card sleeve system, including an inner sleeve and an outer sleeve.

10*a*—Card sleeve system
10*b*—Card sleeve system
102—Outer sleeve
104—Inner sleeve
106—Playing card
402—Inner top edge
404—Inner bottom edge
406—Inner left edge
408—Inner right edge
410—Inner sleeve height
412—Inner sleeve width
414—Right angle
416—Rounded corner
418—Inner sleeve pocket
420—Inner front sheet
422—Inner back sheet
424—Inner side wall
426—Inner sleeve thickness
428—Inner sleeve opening
602—Outer top edge
604—Outer bottom edge
606—Outer left edge
608—Outer right edge
610—Outer sleeve height
612—Outer sleeve width
614—Outer sleeve pocket
616—Outer front sheet
618—Outer back sheet
620—Outer side wall
622—Outer sleeve thickness
624—Outer sleeve opening

DETAILED DESCRIPTION

Owners of collectibles often seek out solutions to protect their investments. In the case of trading cards or playing cards, the solutions offered are often limited to a few options. For keeping multiple cards protected at once, there is the option of deck boxes, varying greatly in size and scope of how many cards may be preserved together. For protecting individual cards, however, the options are limited to using some type of sleeve. For additional protection, two sleeves may be used in tandem—an inner sleeve and an outer sleeve—with their openings on opposing sides so that the card is protected along all four edges.

Traditional card sleeves have long been made with rectangular form—that is to say, all four corners of the card sleeves have sharp, right-angle or approximately right-angle corners. These sharp angles can dig into the palm of a user during use and while shuffling their deck of cards. This can be solved by rounding the corners of the card sleeves. However, rounding all of the corners of a card sleeve creates weak welds between the front sheet and back sheet, creating a higher likelihood of failure of the sleeve as a whole—in some cases the sleeve may simply separate down the weld.

A solution to both of these issues, and the content of this disclosure, is a card sleeve, and a card sleeve system, which uses rounded corners on one side of the sleeve, and right-angle, or approximately right-angle corners on the opposite side of the sleeve. The right-angled corners allow for a stronger weld of the back sheet and front sheet, and thus an overall greater structural integrity. The rounded corners prevent the user from having any pain or discomfort from sharp edges digging into their palms during handling of the cards.

An additional deficiency in the prior art, for both all right-angle corners or all rounded corners, is that it is impossible to tell if all cards are facing in the same direction without looking at each individual card while it is face up. This is important in card games where the player wants to be able to read any effects listed on their card, or intend to deal the cards while they are facing a specific direction. Card sleeves with one side having right-angle corners and the opposite side having rounded corners can fix this issue by keeping the bottom of every card at the same styled end. For instance, if the bottom of the card is always at the edge of the card with rounded corners, a user knows immediately how to face the card without having to turn the card over to check.

FIG. 1 shows a front view of an exemplary card sleeve system 10*a*. As illustrated in FIG. 1, a card sleeve system 10*a* may include an outer sleeve 102, an inner sleeve 104, and a playing card 106. The playing card 106 is not necessary for the system to be complete, however, the purpose of the card sleeve system 10*a* is to provide an element of protection (i.e., wear and tear, light exposure, etc.) to some object, and thus a playing card 106 is shown throughout the figures and described throughout this disclosure with the purpose of providing a reference as to the actions being performed by the outer sleeve 102 and the inner sleeve 104.

Inner sleeve 104 is illustrated in broken lines, illustrating that inner sleeve 104 is shown within outer sleeve 102. Likewise, playing card 106 is illustrated with broken lines to illustrate that playing card 106 is shown within inner sleeve 104.

Figure 2A:
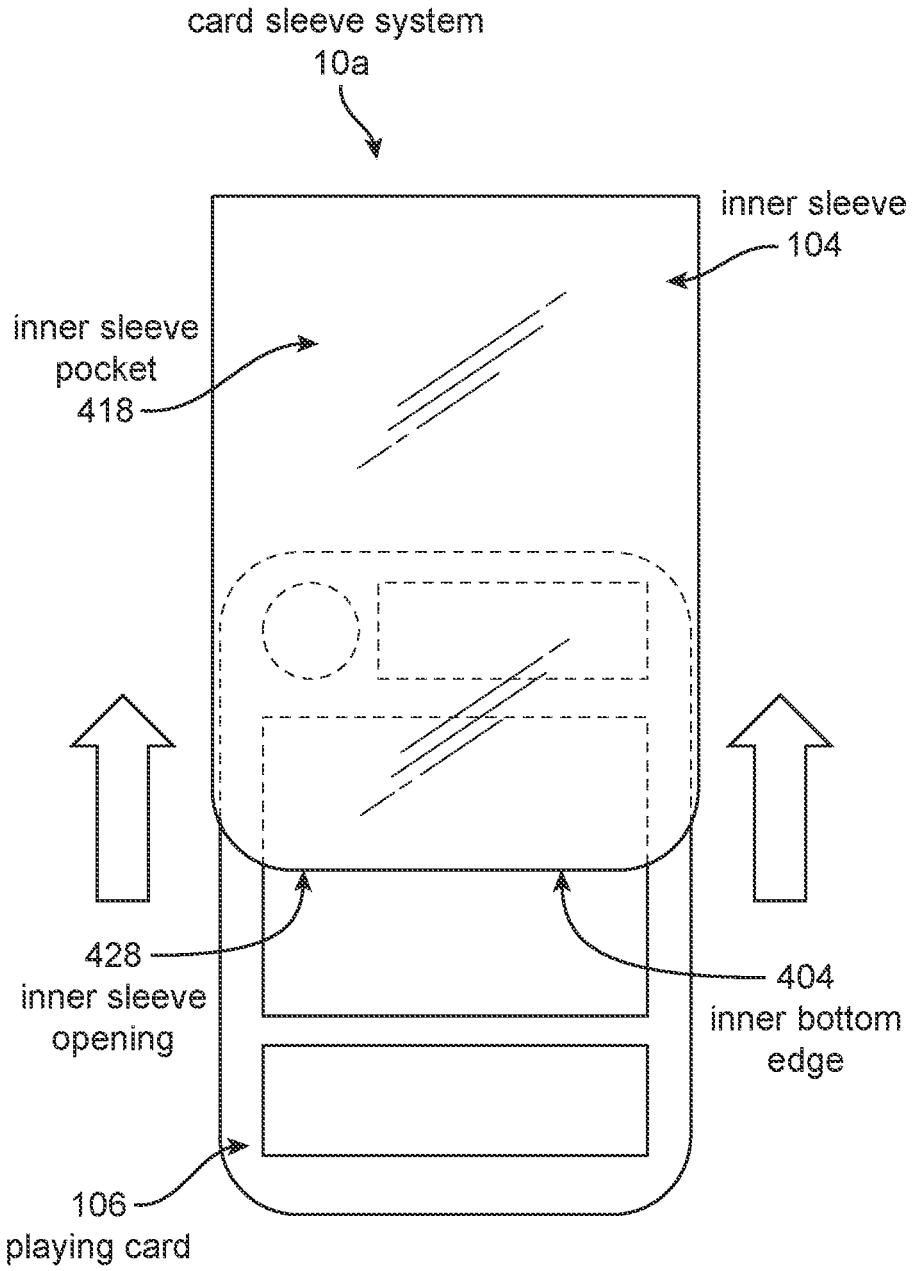
FIG. 2A is a front view of a playing card being inserted into an inner sleeve, according to some examples.
Figure 2B:
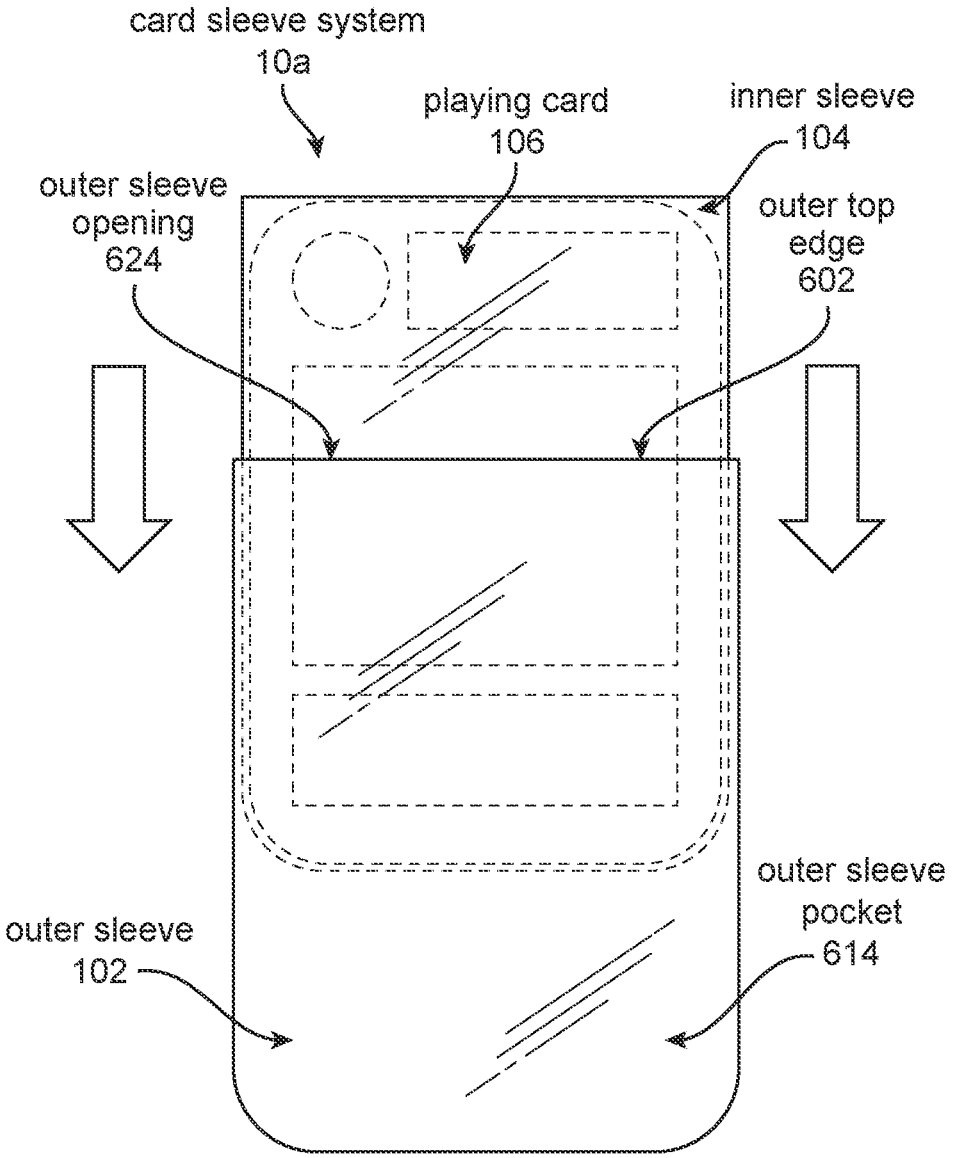
FIG. 2B is a front view of a playing card inside of an inner sleeve being inserted into an outer sleeve, forming the example card sleeve system of FIG. 1.

FIGS. 2A and 2B illustrate front views of playing card 106 being inserted into the inner sleeve 104 (FIG. 2A), and then this assembly being inserted into outer sleeve 102 (FIG. 2B) to complete exemplary card sleeve system 10*a*.

FIG. 2A shows the playing card 106 being inserted into the bottom of the inner sleeve 104, where there is an opening that will be described in greater detail in FIGS. 4A, 4B, and 5. According to FIG. 2A, the inner sleeve 104 is configured to receive the playing card 106 through the inner sleeve opening 428 along the inner bottom edge 404, whereby the playing card 106 slides into the inner sleeve pocket 418 until the playing card 106 is substantially enclosed by the inner sleeve 104. Arrows are provided to show the direction of movement of playing card 106 traveling with respect to inner sleeve 104 during the motion of entry. The playing card 106 is illustrated with broken lines only in the area where the playing card 106 has been inserted into the inner sleeve 104 to show the transition from being outside of inner sleeve 104 to being inside of inner sleeve 104.

FIG. 2B, likewise, shows the assembly of the playing card 106 inside of inner sleeve being inserted into the top of the outer sleeve 102, where there is an opening that will be described in greater detail in FIGS. 6A, 6B, and 7. According to FIG. 2B, the outer sleeve 102 is configured to receive the inner sleeve 104 with the playing card 106 through the outer sleeve opening 624 along the outer top edge 602, whereby the inner sleeve 104 with the playing card 106 slides into the outer sleeve pocket 614 until the inner sleeve 104 with the playing card 106 is substantially enclosed by the outer sleeve 102. Arrows are provided to show the direction of movement of playing card 106 and inner sleeve 104 with respect to outer sleeve 102 during the motion of entry. The playing card 106 is illustrated with broken lines throughout, showing that the entirety of the playing card 106 is within the inner sleeve 104 in FIG. 2B. The inner sleeve 104 is illustrated with broken lines only in the area where the inner sleeve 104 has been inserted into the outer sleeve 102 to show the transition from being outside of outer sleeve 102 to being inside of outer sleeve 102.

Figure 3:
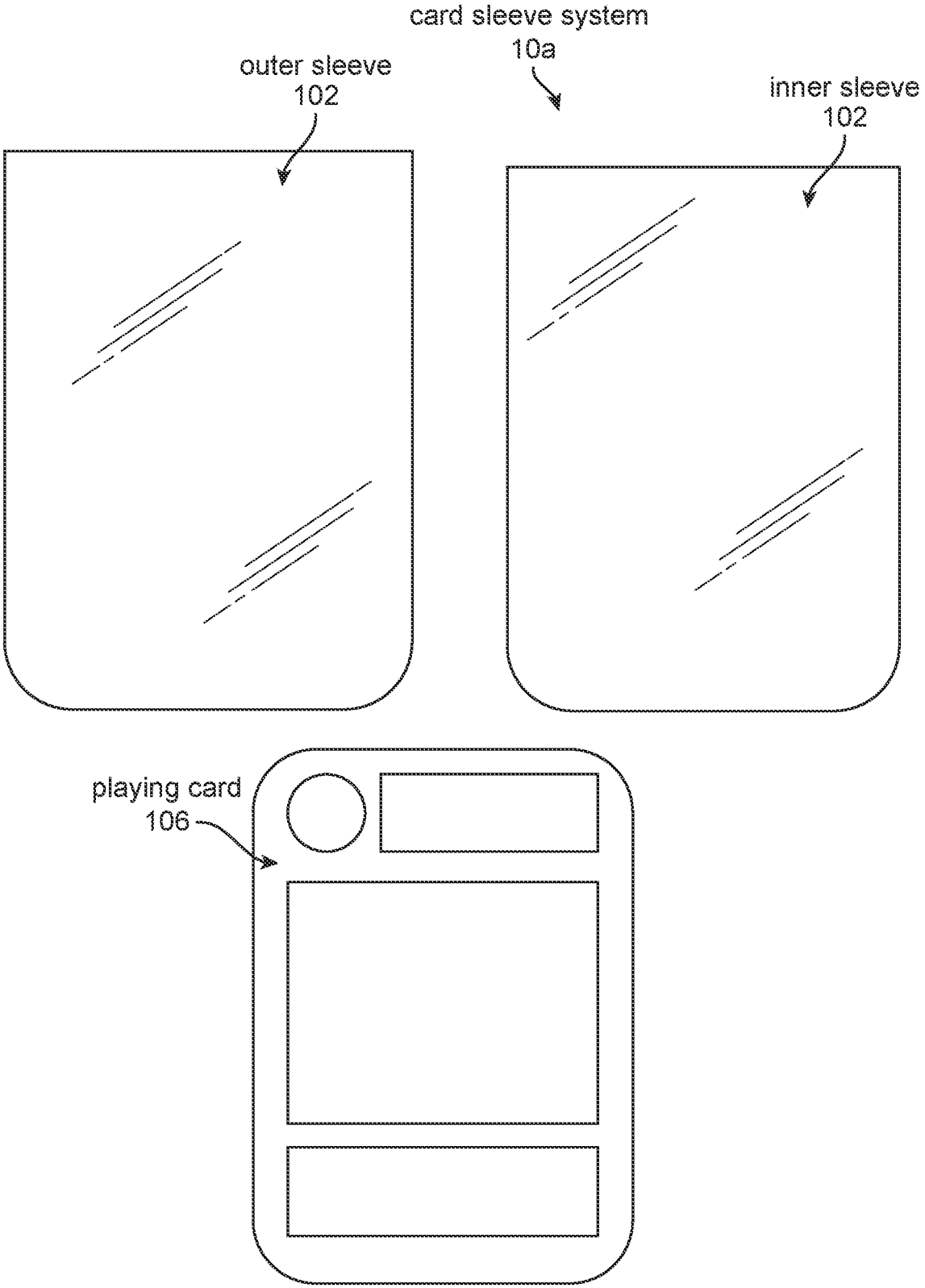
FIG. 3 is an exploded front view of the example card sleeve system of FIG. 1 showing the individual components of the outer sleeve, the inner sleeve, and the playing card.

FIG. 3 shows the separate components of exemplary card sleeve system 10*a* in an exploded front view. FIG. 3 allows a clearer view of the outer sleeve 102, the inner sleeve 104, and the playing card 106, as well as the potential differences in sizes between these distinct components.

Figure 4A:
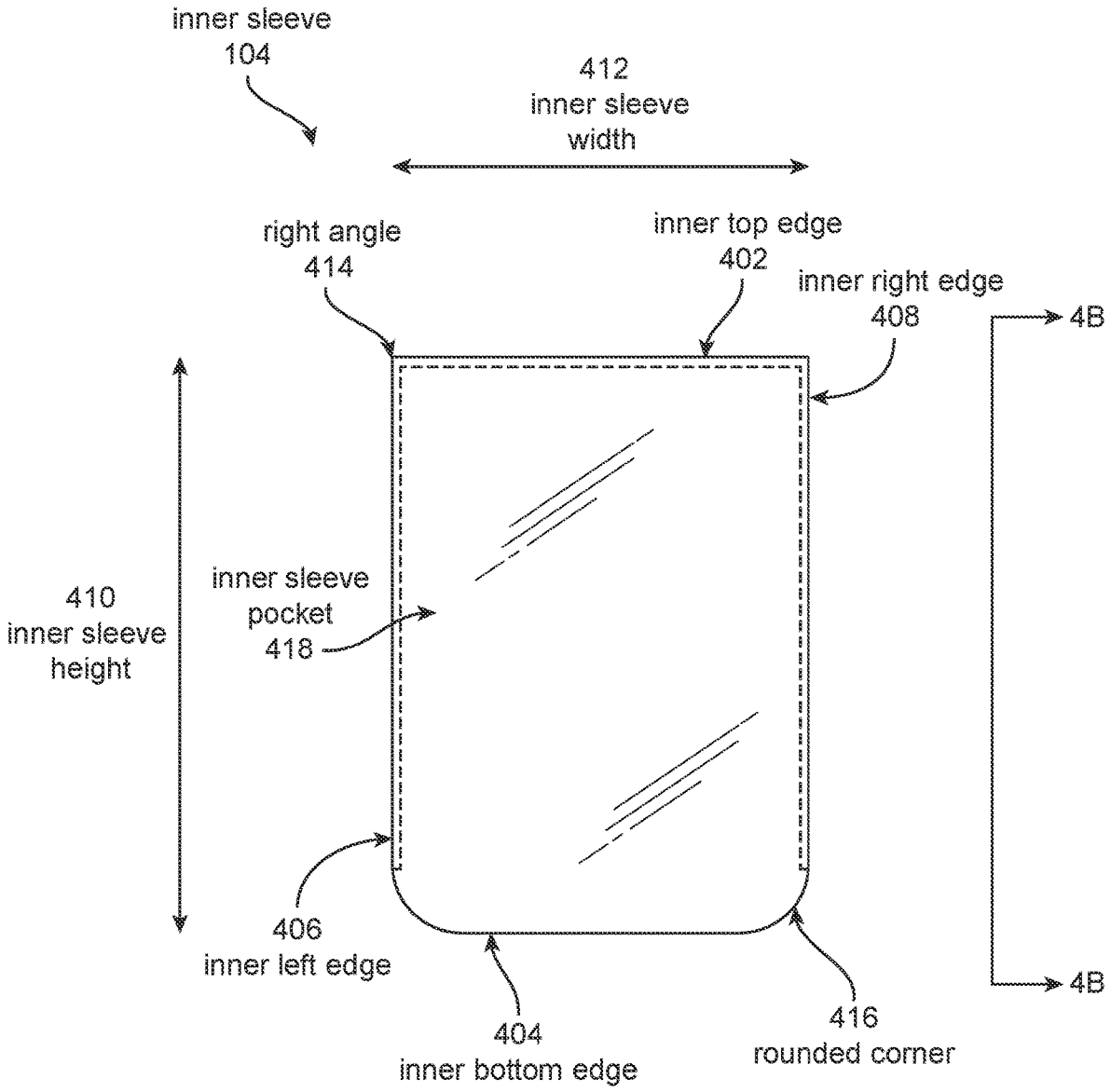
FIG. 4A is a front view of an inner sleeve, according to some examples.

FIG. 4A illustrates a front view of an exemplary inner sleeve 104. As shown, the inner sleeve 104 comprises, generally, four distinct sides. These sides include an inner top edge 402 and an inner bottom edge 404 which is at least partially parallel to, and opposite of, the inner top edge 402. Also included are an inner left edge 406 and an inner right edge 408 which is at least partially parallel to, and opposite of, the inner left edge 406. Inner left edge 406 and inner right edge 408 are both at least partially perpendicular to inner top edge 402 and inner bottom edge 404.

Where the inner top edge 402 meets the inner left edge 406, a right angle 414 is shown. It is understood that this angle approximates a right angle 414, and degrees of variance between the inner top edge 402 and the inner left edge 406 are permitted, as tolerance is expected in any manufacturing process. Likewise, where inner top edge 402 meets the inner right edge 408, a right angle 414 is also shown, but not labeled to avoid cluttering the drawing and facilitate readability. It is also understood that these two top corners are approximately equal in degrees to one another, but perfect reflection is not expected nor needed.

Where inner bottom edge 404 meets inner right edge 408, a rounded corner 416 is shown. Likewise, where inner bottom edge 404 meets inner left edge 406, a rounded corner 416 is also shown, but not labeled, again to avoid cluttering of drawing and facilitate readability. Similar to the right angles 414, it is understood that the rounded corners 416 are approximately equal to one another, but perfect reflection is not expected nor needed.

Within the confines of the inner top edge 402, inner bottom edge 404, inner left edge 406, and inner right edge 408, exists an inner sleeve pocket 418. The inner sleeve pocket 418 is configured to receive an object, such as a playing card 106, through the inner bottom edge 404, and hold the entirety of said object within its confines as indicated by the broken lines. As is shown, the inner sleeve pocket 418 extends to the beginning of the rounded corners 416, showing that the opening into the inner sleeve pocket 418 includes both rounded corners 416 not being attached between the two sheets that make up inner sleeve 104 (the inner front sheet 420 and the inner back sheet 422, see FIG. 4B).

Inner sleeve 104 has an inner sleeve height 410 and inner sleeve width 412 that may vary depending on the needs of the user. To proceed with the analysis of a playing card 106—a standard playing card commonly has a height of approximately 88 millimeters and a width of approximately 63 millimeters. In such a case, the inner sleeve 104 would be sized slightly larger than these dimensions. Exemplary dimensions include an inner sleeve height 410 of approximately 89.4 millimeters and an inner sleeve width 412 of approximately 64.2 millimeters. These dimensions allow the thickness of the walls of inner sleeve 104 to still permit the playing card 106 to enter the inner sleeve 104. To allow for tolerance, a user may desire a range for these values to fall within. Assuming a tolerance of about 0.5 millimeters, the inner sleeve height 410 may fall between the values of 88.9 millimeters and 89.9 millimeters, and the inner sleeve width 412 may fall between the values of 63.7 millimeters and 64.7 millimeters.

As an additional example, Japanese playing cards 106 commonly have a height of approximately 59 millimeters and a width of approximately 86 millimeters. In such a case, the inner sleeve 104 would, again, be slightly larger than these dimensions to prevent the thickness of the walls from interfering with the playing card 106 during insertion. Exemplary dimensions for such a case include an inner sleeve height 410 of approximately millimeters and an inner sleeve width 412 of approximately 60.3 millimeters. As described previously, a user may desire a range for the values to fall into, to allow for tolerance of the machines being used to create the card sleeve system 10*a*. Again, assuming a tolerance of about 0.5 millimeters, the inner sleeve height 410 may fall between the values of 86.5 millimeters and 87.5 millimeters, and the inner sleeve width 412 may fall between the values of 59.8 millimeters and 60.8 millimeters.

Figure 4B:
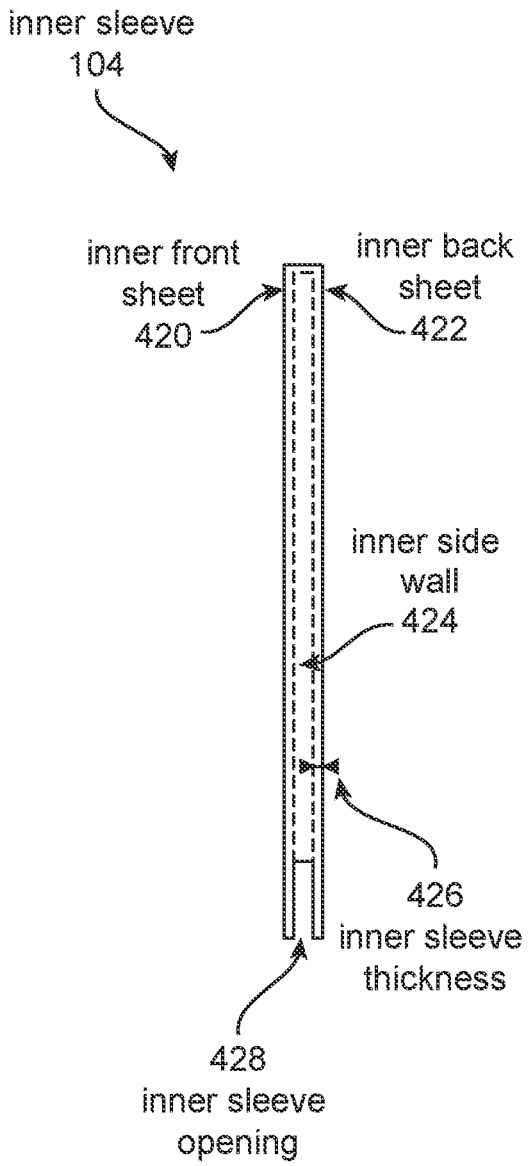
FIG. 4B is a side view of the inner sleeve of FIG. 4A.

As shown in FIG. 4A, FIG. 4B is a side view, specifically from the right side, of the inner sleeve 104 of FIG. 4A. As is shown, the inner sleeve 104 may comprise an inner front sheet 420 welded to an inner back sheet 422 along all of the sides that do not consist of the opening to the inner sleeve pocket 418 (the inner top edge 402, the inner left edge 406, and the inner right edge 408). The area where the inner front sheet 420 and inner back sheet 422 are welded together are shown as inner side wall 424. Along the inner bottom edge 404 exists an inner sleeve opening 428 for access to the inner sleeve pocket 418. It is along this inner bottom edge 404 that an object, such as a playing card 106 may enter.

The sheets of inner sleeve 104 have an inner sleeve thickness 426, which is the thickness of the material used to manufacture the sheets that make up inner sleeve 104. Because the inner sleeve thickness 426 is not dependent on the size of the object placed within the inner sleeve pocket 418, this inner sleeve thickness 426 will not change in the presented examples of a standard playing card 106 and a Japanese playing card 106. The inner sleeve thickness 426 in either scenario may be approximately 0.05 millimeters. Because of fluctuations in material thickness in the manufacturing process, a user may desire a range for the values of this inner sleeve thickness 426 to fall into. Assuming a tolerance of about 0.005 millimeters, the inner sleeve thickness 426 may fall between the values of 0.045 millimeters and 0.055 millimeters.

In some examples, the inner front sheet 420 is optically clear. The inner back sheet 422 may also be optically clear, or it may be at least partially opaque or fully opaque. Both the inner front sheet 420 and the inner back sheet 422 may be made from polypropylene or an ecological friendly equivalent, such as a bio-based polypropylene.

Figure 5:
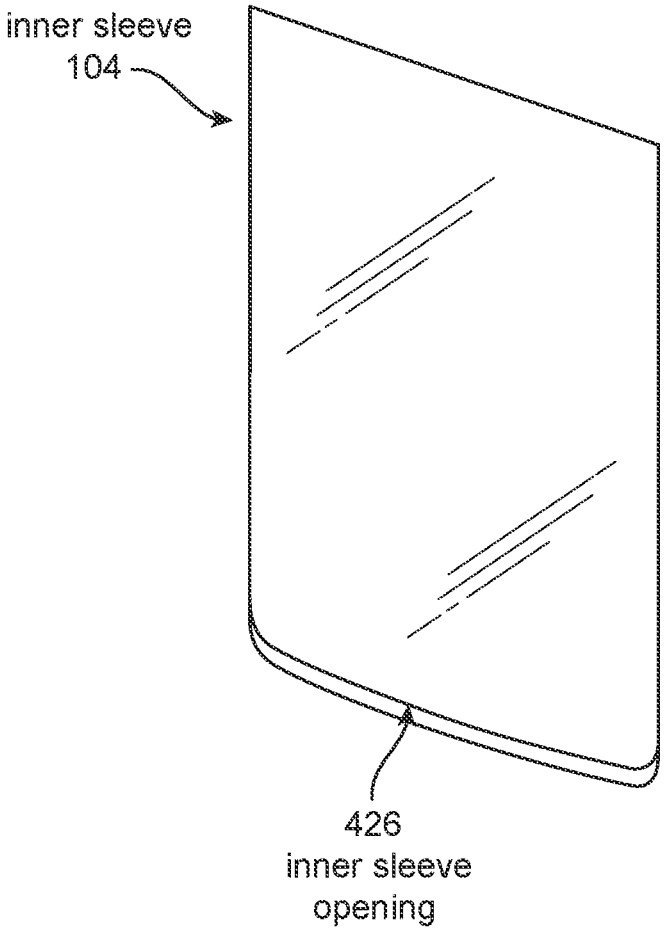
FIG. 5 is a profile view of the inner sleeve of FIGS. 4A and 4B.

FIG. 5 is a profile view of the inner sleeve of FIGS. 4A and 4B, showing the inner sleeve opening 428 "puckered" to further indicate how the opening operates. It is understood that, while the inner sleeve opening 428 is shown and described along the inner bottom edge 404, this opening may be presented along any of inner left edge 406 or inner right edge 408 for "side-loading" of the playing card 106, or along inner top edge 402.

Figure 6A:
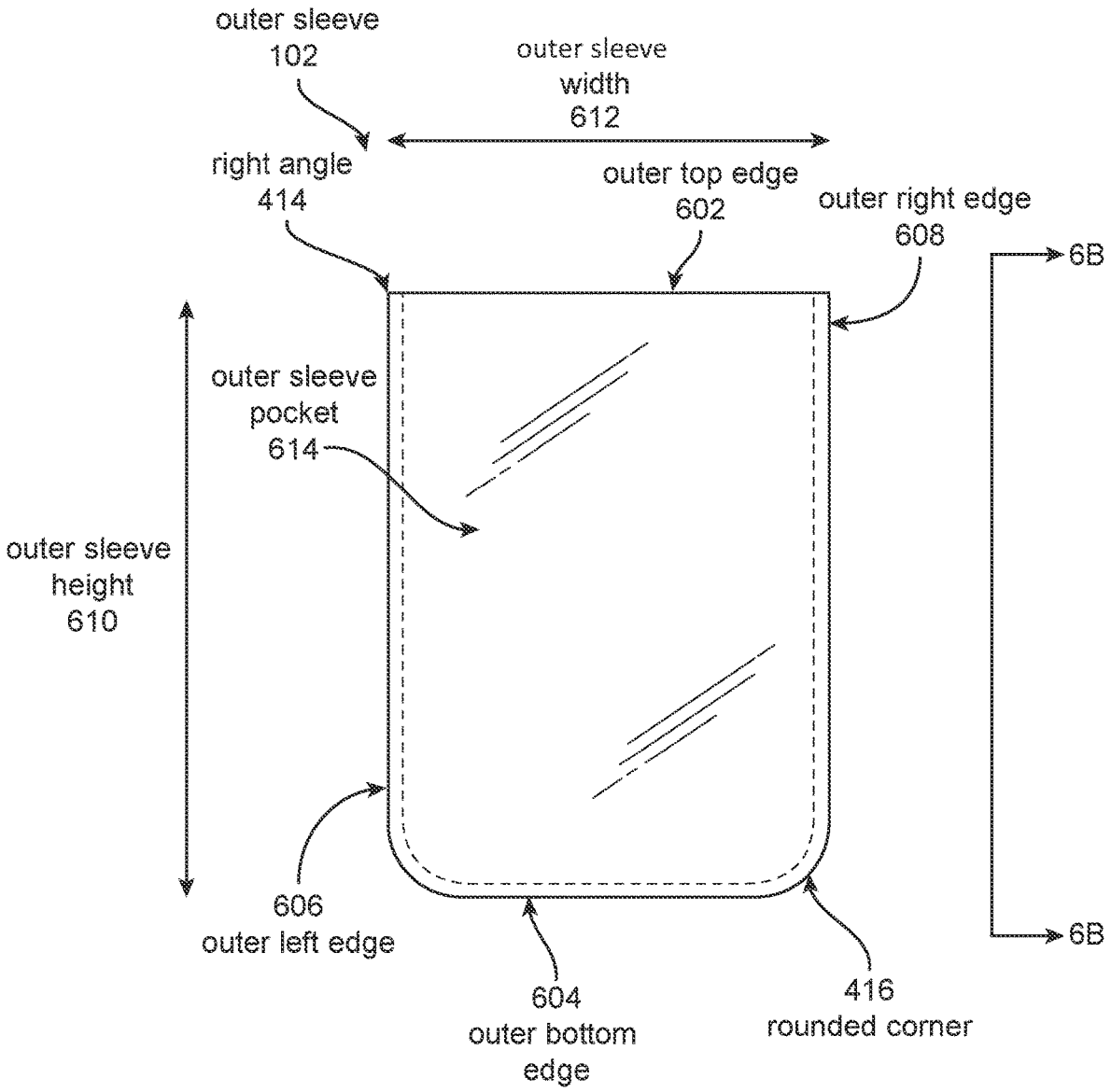
FIG. 6A is a front view of an outer sleeve, according to some examples.

FIG. 6A illustrates a front view of an exemplary outer sleeve 102. The outer sleeve 102 shares a lot of similarities with the inner sleeve 104, with the exceptions of the sizes (to permit the inner sleeve 104 to enter the outer sleeve 102), as well as the location of the opening. While there are many similarities between the outer sleeve 102 and the inner sleeve 104, the features will be reiterated here to facilitate readability. As shown, the outer sleeve 102 comprises, generally, four distinct sides. These sides include an outer top edge 602 and an outer bottom edge 604 which is at least partially parallel to, and opposite of, the outer top edge 602. Also included are an outer left edge 606 and an outer right edge which is at least partially parallel to, and opposite of, the outer left edge 606. Outer left edge 606 and outer right edge 608 are both at least partially perpendicular to outer top edge 602 and outer bottom edge 604.

Where the outer top edge 602 meets the outer left edge 606, a right angle 414 is shown. It is understood that this angle approximates a right angle 414, and degrees of variance between the outer top edge 602 and the outer left edge 606 are permitted, as tolerance is expected in any manufacturing process. Likewise, where outer top edge 602 meets the outer right edge 608, a right angle 414 is also shown, but not labeled to avoid cluttering the drawing and facilitate readability. It is also understood that these two top corners are approximately equal in degrees to one another, but perfect reflection is not expected nor needed.

Where outer bottom edge 604 meets outer right edge 608, a rounded corner 416 is shown. Likewise, where outer bottom edge 604 meets outer left edge 606, a rounded corner 416 is also shown, but not labeled, again to avoid cluttering of drawing and facilitate readability. Similar to the right angles 414, it is understood that the rounded corners 416 are approximately equal to one another, but perfect reflection is not expected nor needed.

Within the confines of the outer top edge 602, outer bottom edge 604, outer left edge 606, and outer right edge 608, exists an outer sleeve pocket 614. The outer sleeve pocket 614 is configured to receive an object, such as a playing card 106, through the outer top edge 602, and hold the entirety of said object within its confines as indicated by the broken lines. As is shown, the outer sleeve pocket 614 extends to the outer top edge 602, showing that the opening into the outer sleeve pocket 614 exists on this outer top edge 602 as opposed to the outer bottom edge 604, as is the case with the inner sleeve 104.

Outer sleeve 102 has an outer sleeve height 610 and outer sleeve width 612 that may vary depending on the needs of the user. Using the assumptions of a standard playing card 106 and the resulting dimensions of an inner sleeve 104, exemplary dimensions may include an outer sleeve height 610 of approximately 91.8 millimeters and an outer sleeve width 612 of approximately 66.8 millimeters. These dimensions allow the thickness of the walls of outer sleeve 102 to still permit the inner sleeve 104 to enter the outer sleeve 102. To allow for tolerance, a user may desire a range for these values to fall within. Assuming a tolerance of about 0.5 millimeters again, the outer sleeve height 610 may fall between the values of 91.3 millimeters and 92.3 millimeters, and the outer sleeve width 612 may fall between the values of 66.3 millimeters and 67.3 millimeters.

Following along with the additional example of Japanese playing cards 106, exemplary dimensions may include an outer sleeve height 610 of approximately 88.8 millimeters and an outer sleeve width 612 of approximately 62.1 millimeters. As described previously, a user may desire a range for the values to fall into, to allow for tolerance of the machines being used to create the card sleeve system 10*a*. Again, assuming a tolerance of about 0.5 millimeters, the outer sleeve height 610 may fall between the values of 88.3 millimeters and 89.3 millimeters, and the outer sleeve width 612 may fall between the values of 61.6 millimeters and 62.6 millimeters.

Figure 6B:
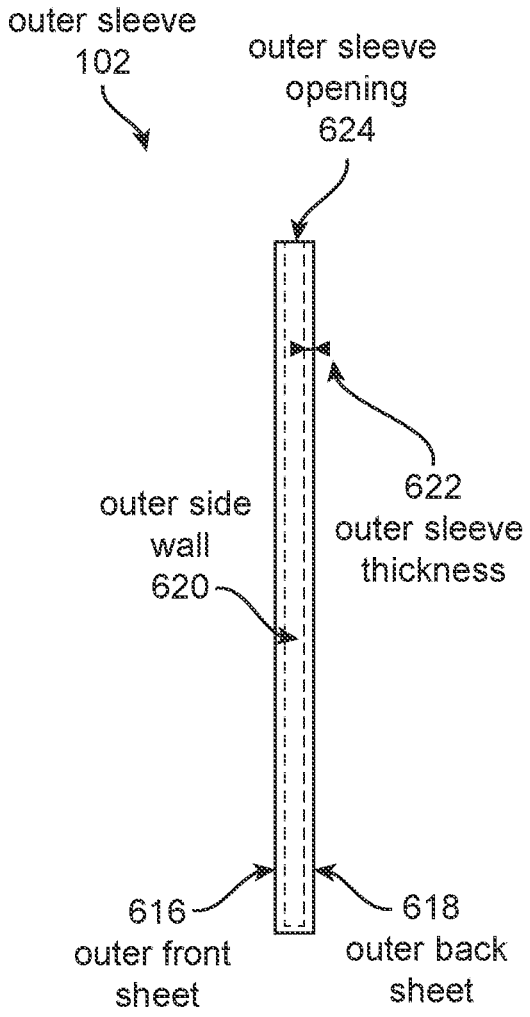
FIG. 6B is a side view of the outer sleeve of FIG. 6A.

As shown in FIG. 6A, FIG. 6B is a side view, specifically from the right side, of the outer sleeve 102 of FIG. 6A. As is shown, the outer sleeve 102 may comprise an outer front sheet 616 welded to an outer back sheet 618 along all of the sides that do not consist of the opening to the outer sleeve pocket 614 (the outer bottom edge 604, the outer left edge 606, and the outer right edge 608). The area where the outer front sheet 616 and outer back sheet 618 are welded together are shown as outer side wall 620. Along the outer top edge 602 exists an outer sleeve opening 624 for access to the outer sleeve pocket 614. It is along this outer bottom edge 602 that the inner sleeve 104, an object such as a playing card 106, or a combination thereof may enter.

The sheets that make up outer sleeve 102 have an outer sleeve thickness 622, which is the thickness of the material used to manufacture the sheets of outer sleeve 102. Because the outer sleeve thickness 622 is not dependent on the size of the object, or inner sleeve 104, placed within the outer sleeve pocket 614, this outer sleeve thickness 622 will not change in the presented examples of a standard playing card 106 and a Japanese playing card 106. Additionally, the outer front sheet 616 and the outer back sheet 618 may comprise different thicknesses.

For example, the outer front sheet 616 may have an outer sleeve thickness 622 of approximately 0.12 millimeters. Because of fluctuations in material thickness in the manufacturing process, a user may desire a range for the values of this outer sleeve thickness 622 to fall into. Similar to the inner sleeve thickness 426, assuming a tolerance of about 0.005 millimeters, the outer sleeve thickness 622 of the outer front sheet 616 in this example may fall between the values of 0.115 millimeters and 0.125 millimeters.

The outer back sheet 618 may have an outer sleeve thickness 622 of approximately 0.14 millimeters. Again assuming a tolerance of about 0.005 millimeters, the outer sleeve thickness 622 of the outer back sheet 618 in this example may fall between the values of 0.135 millimeters and 0.145 millimeters.

It is understood that these dimensions are exemplary only and that it is not strictly necessary for the outer sleeve thickness 622 of the outer front sheet 616 to be different than the outer sleeve thickness 622 of the outer back sheet 618.

In some examples, the outer front sheet 616 is optically clear. Additionally or alternatively, the outer front sheet 616 may be translucent. According to some examples, the outer front sheet 616 comprises a matte finish. The outer front sheet 616 may also comprise an anti-glare finish. The matte or anti-glare finishes can reduce the effect of foil from cards, and allow the cards to show up better on camera, facilitating online play or coverage, such as in a tournament.

The outer back sheet 618 may be optically clear, translucent, at least partially opaque, or fully opaque. In some examples, the outer back sheet 618 is colored. Additionally or alternatively, the outer back sheet 618 may feature artwork.

Both the outer front sheet 616 and the outer back sheet 618 may be made from polypropylene or an ecologically friendly equivalent, such as a bio-based polypropylene.

Figure 7:
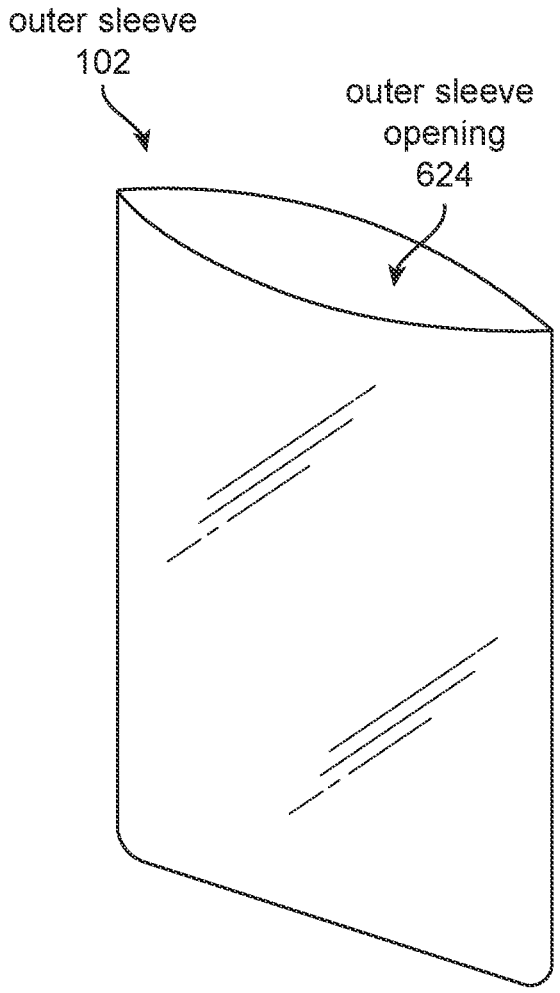
FIG. 7 is a profile view of the outer sleeve of FIGS. 6A and 6B.

FIG. 7 is a profile view of the outer sleeve 102 of FIGS. 6A and 6B, showing the outer sleeve opening 624 "puckered" to further indicate how the opening operates. It is important to note, similar to the description of the inner sleeve 104 in FIG. 5, that while the outer sleeve opening 624 is shown and described along the outer top edge 602, this opening may be presented along any of outer left edge 606 or outer right edge 608 for "side-loading" of the playing card 106 or the inner sleeve 104, or along outer bottom edge 604. It may be desired that the outer sleeve opening 624 is along an edge opposite that of the inner sleeve opening 428 to further prevent detriment or other particulate from accessing the playing card 106, but this, also, is not strictly necessary.

Figure 8:
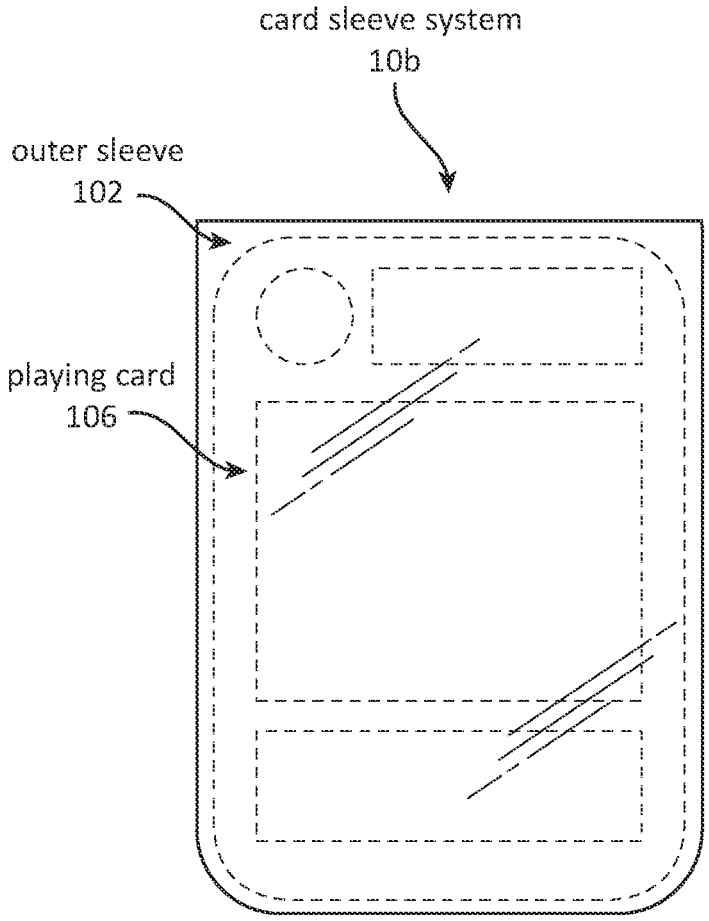
FIG. 8 is a front view of another example card sleeve system, including an outer sleeve.

FIG. 8 shows a front view of another exemplary card sleeve system 10*b*. As illustrated in FIG. 8, a card sleeve system 10*b* may include an outer sleeve 102 and a playing card 106. The playing card 106 is not necessary for the system to be complete, however, as already discussed in FIG. 1 with regards to exemplary card sleeve system 10*a*, the purpose of the card sleeve system 10*b* is to provide an element of protection (i.e., wear and tear, light exposure, etc.) to some object, and thus a playing card 106 is shown throughout the figures and described throughout this disclosure with the purpose of providing a reference as to the actions being performed by the outer sleeve 102. Playing card 106 is illustrated with broken lines to illustrate that playing card 106 is shown within outer sleeve 102.

Figure 9:
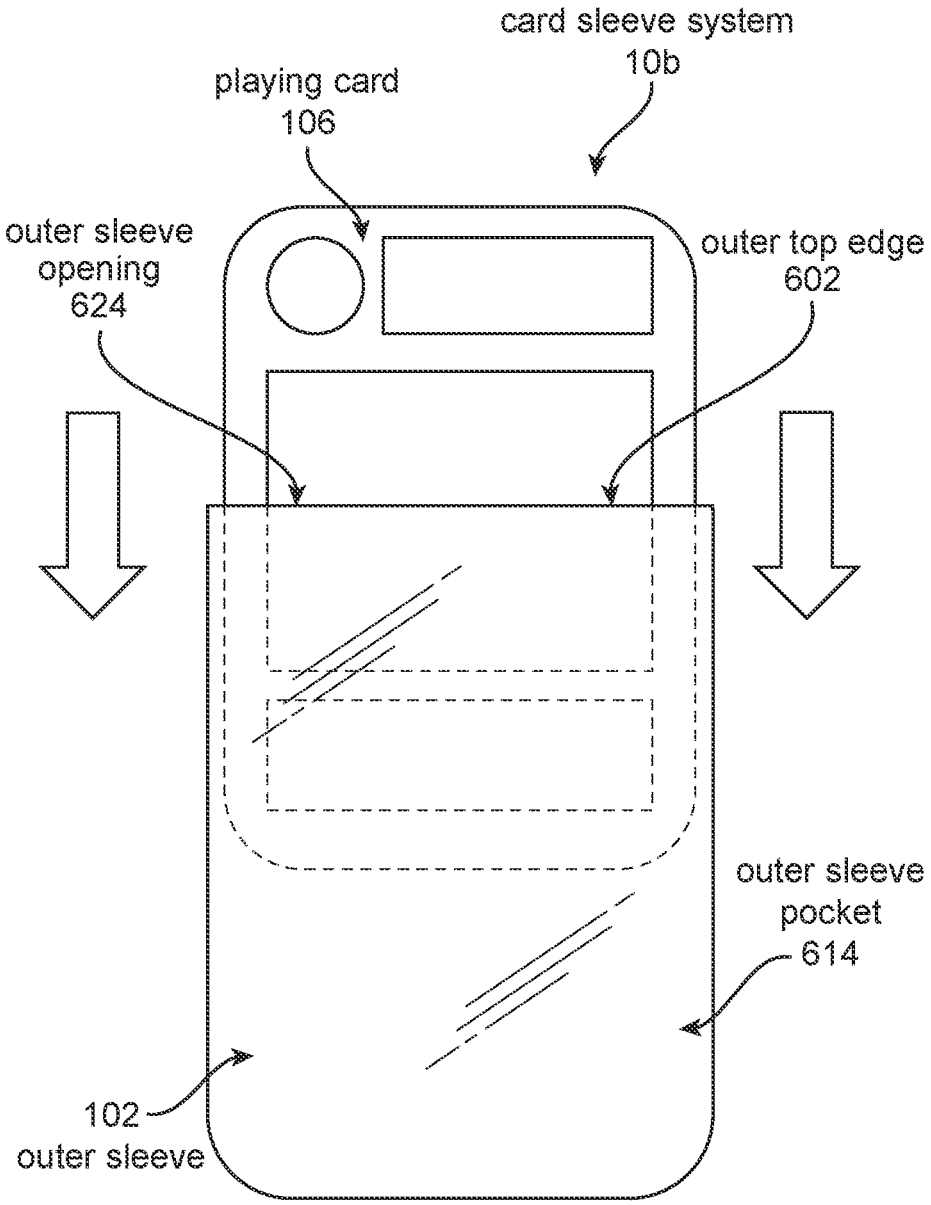
FIG. 9 is a front view of a playing card being inserted into an outer sleeve, forming the example card sleeve system of FIG. 8.

FIG. 9 illustrates a front view of playing card 106 being inserted into the outer sleeve 102 to complete exemplary card sleeve system 10*b*. As shown, the playing card 106 is inserted into the top of the outer sleeve 102, where there is an opening as described in FIGS. 6A, 6B, and 7. According to FIG. 9, the outer sleeve 102 is configured to receive the playing card 106 through the outer sleeve opening 624 along the outer top edge 602, whereby the playing card 106 slides into the outer sleeve pocket 614 until the playing card is substantially enclosed by the outer sleeve 102. Arrows are provided to show the direction of movement of playing card 106 traveling with respect to outer sleeve 102 during the motion of entry. The playing card 106 is illustrated with broken lines only in the area where the playing card 106 has been inserted into the outer sleeve 102 to show the transition from being outside of outer sleeve 102 to being inside of outer sleeve 102.

Figure 10:
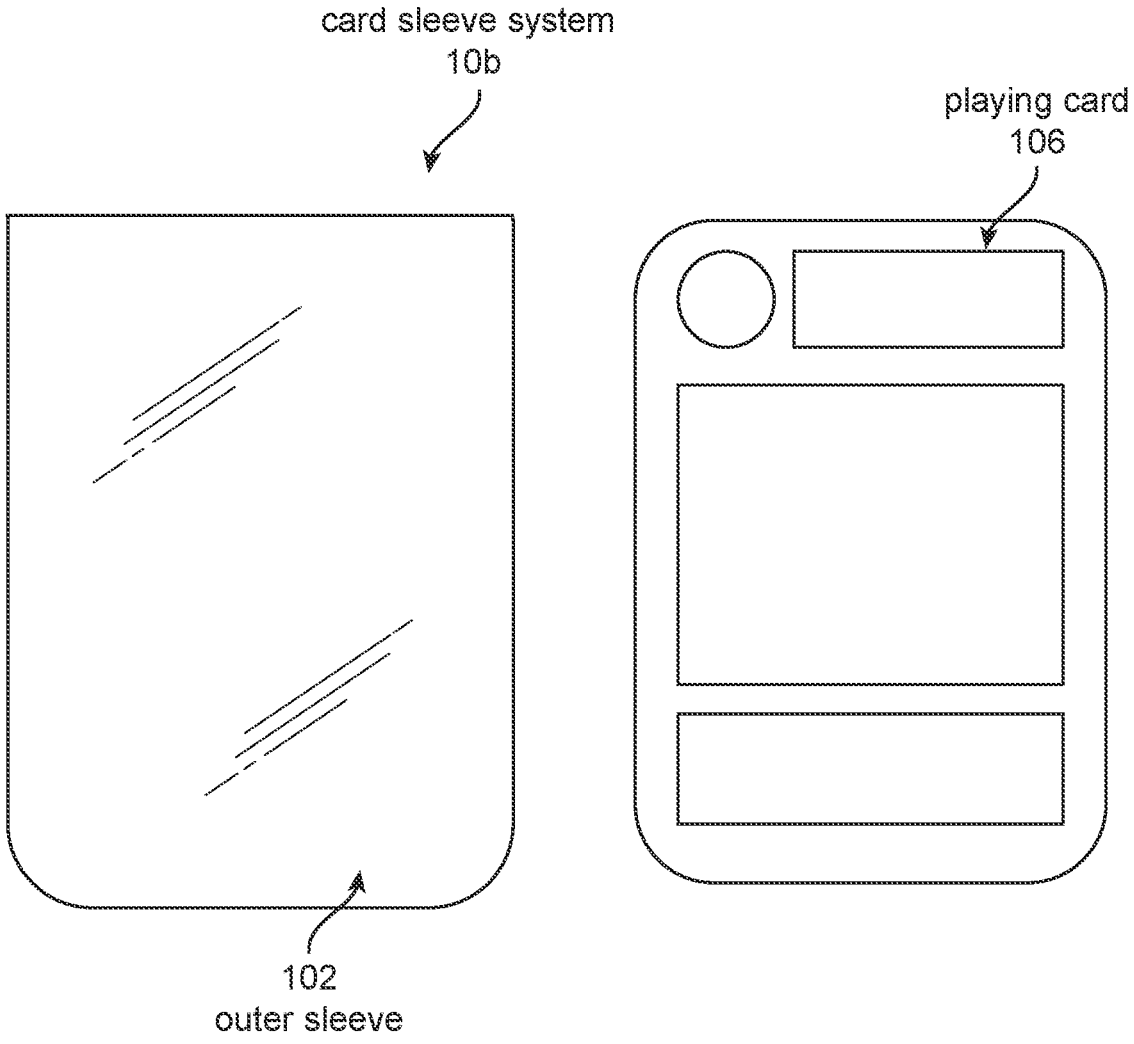
FIG. 10 is an exploded front view of the example card sleeve system of FIG. 8 showing the individual components of the outer sleeve and the playing card.

FIG. 10 shows the separate components of exemplary card sleeve system 10*b* in an exploded front view. FIG. 10 allows a clearer view of the outer sleeve 102 and the playing card 106, as well as the potential differences in sizes between these distinct components.

Interpretation

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A card sleeve system comprising:

an inner card sleeve comprising:

an inner front sheet; and an inner back sheet coupled to the inner front sheet along an inner top edge, an inner left edge, and an inner right edge of the inner card sleeve, wherein an inner bottom edge of the inner card sleeve defines an inner opening configured to receive a card, wherein an inner top left corner and an inner top right corner of the inner card sleeve define right angles, wherein an inner bottom left corner and an inner bottom right corner of the inner card sleeve define rounded corners, and wherein the inner front sheet is not bonded to the inner back sheet along the rounded corners of the inner bottom left corner and the inner bottom right corner; and an outer card sleeve configured to receive the inner card sleeve, the outer card sleeve comprising:

an outer front sheet; and an outer back sheet coupled to the outer front sheet along an outer bottom edge, an outer left edge, and an outer right edge of the outer card sleeve, wherein an outer top edge of the outer card sleeve defines an outer opening configured to receive the inner card sleeve, wherein an outer top left corner and an outer top right corner of the outer card sleeve define right angles, wherein an outer bottom left corner and an outer bottom right corner of the outer card sleeve define rounded corners, and wherein the rounded corners of the inner bottom left corner and the inner bottom right corner of the inner card sleeve are configured to align with the rounded corners of the outer bottom left corner and the outer bottom right corner of the outer card sleeve when the outer card sleeve receives the inner card sleeve.

2. The card sleeve system of claim 1, wherein the outer front sheet comprises a finish selected from the group consisting of optically clear and translucent.

3. The card sleeve system of claim 2, wherein the outer front sheet further comprises a texture selected from the group consisting of gloss, matte, and anti-glare.

4. The card sleeve system of claim 3, wherein the outer front sheet comprises a color.

5. The card sleeve system of claim 1, wherein the outer back sheet comprises a finish selected from the group consisting of optically clear, translucent, at least partially opaque, and fully opaque.

6. The card sleeve system of claim 5, wherein the outer back sheet comprises a color.

7. The card sleeve system of claim 1, wherein the inner front sheet is optically clear.

8. The card sleeve system of claim 1, wherein the inner back sheet comprises a finish selected from the group consisting of optically clear, at least partially opaque, and fully opaque.

9. A card sleeve system comprising:

an inner card sleeve comprising:

an inner front sheet; and an inner back sheet coupled to the inner front sheet along an inner top edge, an inner left edge, and an inner right edge of the inner card sleeve, wherein an inner top left corner and an inner top right corner of the inner card sleeve define right angles, wherein an inner bottom left corner and an inner bottom right corner of the inner card sleeve define inner rounded corners, wherein an inner opening is defined between i) the inner top left corner and the inner bottom left corner or ii) the inner top right corner and the inner bottom right corner, the inner opening configured to receive a card, and wherein the inner front sheet is not bonded to the inner back sheet along a portion of the inner opening configured to receive the card; and an outer card sleeve configured to receive the inner card sleeve, the outer card sleeve comprising:

an outer front sheet; and an outer back sheet coupled to the outer front sheet along an outer bottom edge, an outer left edge, and an outer right edge of the outer card sleeve, wherein an outer top edge of the outer card sleeve defines an outer opening, wherein an outer top left corner and an outer top right corner of the outer card sleeve define right angles, and wherein an outer bottom left corner and an outer bottom right corner of the outer card sleeve define rounded corner.

10. The card sleeve system of claim 9, wherein the rounded corners of the inner card sleeve are configured to align with the rounded corners of the outer card sleeve when the inner card sleeve is inserted into the outer card sleeve.

11. The card sleeve system of claim 9, wherein the outer front sheet comprises a finish selected from the group consisting of optically clear and translucent.

12. The card sleeve system of claim 9, wherein the outer back sheet comprises a finish selected from the group consisting of optically clear, translucent, at least partially opaque, and fully opaque.

13. The card sleeve system of claim 9, wherein the inner front sheet is optically clear.

14. The card sleeve system of claim 9, wherein the inner back sheet comprises a finish selected from the group consisting of optically clear, at least partially opaque, and fully opaque.

15. A card sleeve system comprising:

an inner card sleeve comprising:

an inner front sheet; and an inner back sheet coupled to the inner front sheet along an inner top edge, an inner left edge, and an inner right edge of the inner card sleeve, wherein an inner bottom edge of the inner card sleeve defines an inner opening configured to receive a card, wherein an inner top left corner and an inner top right corner of the inner card sleeve define right angles, wherein an inner bottom left corner and an inner bottom right corner of the inner card sleeve define rounded corners, and wherein the inner front sheet is not bonded to the inner back sheet along the rounded corners of the inner bottom left corner and the inner bottom right corner; and an outer card sleeve configured to receive the inner card sleeve, the outer card sleeve comprising:

an outer front sheet; and an outer back sheet coupled to the outer front sheet along an outer bottom edge, an outer left edge, and an outer right edge of the outer card sleeve, wherein an outer top edge of the outer card sleeve defines an outer opening configured to receive the inner card sleeve, wherein an outer top left corner and an outer top right corner of the outer card sleeve define right angles, wherein an outer bottom left corner and an outer bottom right corner of the outer card sleeve define rounded corners, and wherein an inner sleeve opening is completely enclosed by the outer card sleeve when the outer card sleeve receives the inner card sleeve.

16. The card sleeve system of claim 15, wherein the rounded corners of the inner card sleeve are configured to align with the rounded corners of the outer card sleeve when the inner card sleeve is inserted into the outer card sleeve.

17. The card sleeve system of claim 15, wherein the outer front sheet comprises a finish selected from the group consisting of optically clear and translucent.

18. The card sleeve system of claim 15, wherein the outer back sheet comprises a finish selected from the group consisting of optically clear, translucent, at least partially opaque, and fully opaque.

19. The card sleeve system of claim 15, wherein the inner front sheet is optically clear.

20. The card sleeve system of claim 15, wherein the inner back sheet comprises a finish selected from the group consisting of optically clear, at least partially opaque, and fully opaque.

* * * * *